US007069139B2

(12) United States Patent
Muto et al.

(10) Patent No.: US 7,069,139 B2
(45) Date of Patent: Jun. 27, 2006

(54) CONTROL DEVICE FOR INTERNAL COMBUSTION ENGINE

(75) Inventors: Harufumi Muto, Aichi-ken (JP); Satoshi Furukawa, Kariya (JP); Isamu Toshimitsu, Toyota (JP)

(73) Assignees: Toyota Jidosha Kabushiki Kaisha, Toyota (JP); Denso Corporation, Kariya (JP)

( * ) Notice: Subject to any disclaimer, the term of this patent is extended or adjusted under 35 U.S.C. 154(b) by 0 days.

(21) Appl. No.: 11/229,515

(22) Filed: Sep. 20, 2005

(65) Prior Publication Data

US 2006/0069491 A1 Mar. 30, 2006

(30) Foreign Application Priority Data

Sep. 24, 2004 (JP) ..... 2004-276693

(51) Int. Cl.
*F02D 45/00* (2006.01)

(52) U.S. Cl. ..... 701/104; 73/118.1; 123/492

(58) Field of Classification Search ..... 701/104, 701/102, 115, 117.3, 118.1, 118.2; 123/480, 123/489, 49
See application file for complete search history.

(56) References Cited

U.S. PATENT DOCUMENTS 4,627,404 A * 12/1986 Saito et al. ..... 123/682
4,761,994 A * 8/1988 Sogawa ..... 73/118.2
4,961,342 A * 10/1990 Matsumoto et al. ..... 73/118.1
5,513,610 A * 5/1996 Okamoto et al. ..... 123/339.15
6,644,104 B1 11/2003 Muto et al. ..... 73/118.2

FOREIGN PATENT DOCUMENTS

JP 8-74650 A * 3/1996
JP A 2000-320391 11/2000
JP A 2002-097994 4/2002

* cited by examiner

*Primary Examiner*—Hieu T. Vo
(74) *Attorney, Agent, or Firm*—Oliff & Berridge, PLC

(57) ABSTRACT

A control device for an internal combustion engine comprises an air flow meter arranged in the intake passage. The air flow meter includes a main passage and a bypass passage and detects a flow rate of air flowing through the bypass passage to detect a flow rate of air flowing through an intake passage. A current intake air flow rate is calculated based on a current throttle opening. When the rapid acceleration of the engine is in process, an air flow meter-detecting intake air flow rate, assuming that air flows through the intake passage at the current intake air flow rate, is estimated considering the pressure loss of the bypass passage of the air flow meter. When an operation other than the rapid acceleration is in process, it is estimated ignoring the pressure loss. The fuel injection amount is calculated from the estimated air flow meter-detecting intake air flow rate.

12 Claims, 9 Drawing Sheets

CONTROL DEVICE FOR INTERNAL COMBUSTION ENGINE

BACKGROUND OF THE INVENTION

1. Field of the Invention

The present invention relates to a control device for an internal combustion engine.

2. Related Art

In order to make an air-fuel ratio accurately equal to a target air-fuel ratio, it is necessary to accurately obtain an in-cylinder intake air amount, which is an amount of intake air sucked into a cylinder and, in particular, the in-cylinder intake air amount at a closing timing of an intake valve. There is known an internal combustion engine in which the in-cylinder intake air amount at the closing timing of the intake valve is estimated using a calculation model modeling an intake pipe which is an intake passage downstream of a throttle valve.

Use of such a calculation model will simplify the calculation. However, calculation results typically include calculation errors which should be eliminated.

Therefore, if an amount of air passing through an air flow meter is referred to as a throttle valve passing-through air amount and an air amount to be detected by the air flow meter is referred to as an air flow meter-detecting air amount, there is known an internal combustion engine in which: an air flow meter is provided for detecting an amount of air flowing through an intake passage of the engine; an in-cylinder intake air amount at the closing timing of the intake valve is estimated; a current throttle valve passing-through air amount is calculated based on a current throttle opening; a current in-cylinder intake air amount is calculated from the current throttle valve passing-through air amount and the above-mentioned calculation model; an air flow meter-detecting air amount assuming that air flows through the intake passage by the calculated current in-cylinder intake air amount is estimated; the current in-cylinder intake air amount is estimated from the estimated air flow meter-detecting air amount and the above-mentioned calculation model; the estimated in-cylinder intake air amount at the closing timing of the intake valve is corrected by a difference between the calculated current in-cylinder intake air amount and the estimated current in-cylinder intake air amount, to calculate the final in-cylinder intake air amount at the closing timing of the intake valve; and the engine is controlled using the thus calculated, final in-cylinder intake air amount at the closing timing of the intake valve (see U.S. Pat. No. 6,644,104).

The difference between the calculated current in-cylinder intake air amount and the estimated current in-cylinder intake air amount represents errors of the calculation model. Therefore, the estimated in-cylinder intake air amount at the closing timing of the intake valve corrected by the difference will represent the in-cylinder intake air amount at the closing timing of the intake valve accurately.

On the other hand, in USP'104, there is provided an air flow meter of a flow dividing type which has a bypass passage through which a part of intake air is introduced and which detects an amount of air passing through the bypass passage to thereby detect an amount of air passing through the air flow meter.

A flow area of the bypass passage is small and, therefore, the pressure loss/drop of the bypass passage should be considered when estimating the air flow meter-detecting air amount. However, in USP'104, the pressure loss of the bypass passage is not considered and, therefore, it may be impossible to accurately obtain the air flow meter-detecting air amount and thus the in-cylinder intake air amount at the closing timing of the intake valve. Accordingly, it may be impossible to control the engine accurately.

SUMMARY OF THE INVENTION

An object of the present invention is to provide a control device for an internal combustion engine, capable of accurately obtaining the in-cylinder intake air amount at the closing timing of the intake valve, and of accurately conducting the engine control.

According to the present invention, there is provided a control device for an internal combustion engine having an intake passage and a throttle valve arranged in the intake passage, comprising: an air flow meter arranged in the intake passage, the air flow meter including a main passage and a bypass passage and detecting an amount of air flowing through the bypass passage to detect an amount of air flowing through the intake passage; an obtaining means for obtaining the current throttle opening; a calculation means for calculating the current intake air amount based on the current throttle opening obtained by the obtaining means; an estimating means for estimating an air flow meter-detecting intake air amount assuming that air flows through the intake passage by the current intake air amount calculated by the calculation means and considering the pressure loss of the bypass passage of the air flow meter, the air flow meter-detecting intake air amount being an intake air amount to be detected by the air flow meter; and control means for controlling the engine based on the air flow meter-detecting intake air amount estimated by the estimating means.

The present invention may be more fully understood from the description of the preferred embodiments according to the invention as set forth below, together with the accompanying drawings.

DESCRIPTION OF THE PREFERRED EMBODIMENTS

Figure 1:
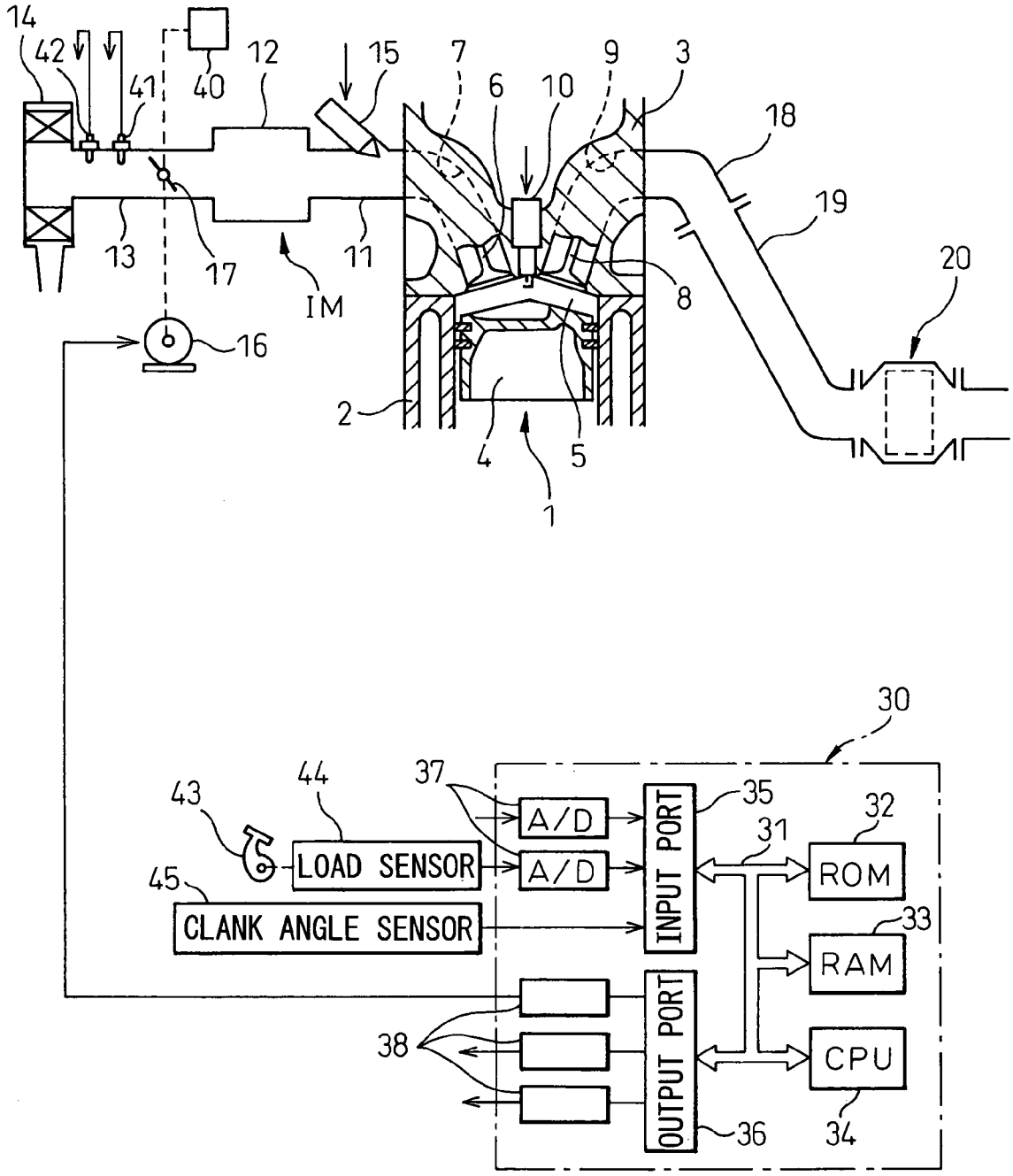
FIG. 1 shows an overall view of an internal combustion engine.

FIG. 1 shows a case in which the present invention is applied to an internal combustion engine of a spark ignition type. Alternatively, the present invention may also be applied to an internal combustion engine of a compression ignition type.

Referring to FIG. 1, the reference numeral 1 designates an engine body having four cylinders, for example, 2 designates a cylinder block, 3 designates a cylinder head, 4 designates a piston, 5 designates a combustion chamber, 6 designates intake valves, 7 designates intake ports, 8 designates exhaust valves, 9 designates exhaust ports and 10 designates a spark plug. The intake ports 7 are connected to a surge tank 12 through corresponding intake branches 11, and the surge tank 12 is connected to an air cleaner 14 through an intake duct 13. A fuel injector 15 is arranged in each intake branch 11, and a throttle valve 17 driven by a step motor 16 is arranged in the intake duct 13. Note that the intake duct 13 downstream of the throttle valve 17, the surge tank 12, the intake branches 11, and the intake ports 7 are referred to as an intake pipe IM, in the present specification.

On the other hand, the exhaust ports 9 are connected via an exhaust manifold 18 and an exhaust pipe 19 to a catalytic converter 20, and the catalytic converter 20 is communicated to the outside air via a muffler (not shown).

An electronic control unit 30 is constituted of a digital computer including a ROM (read-only memory) 32, a RAM (random access memory) 33, a CPU (microprocessor) 34, an input port 35 and an output port 36, which are connected to each other through a bidirectional bus 31. A throttle opening sensor 40 is attached to the throttle valve 17 for detecting an opening of the throttle valve 17, i.e., a throttle opening θt. An air flow meter 41 for detecting a flow rate of intake air flowing through the intake passage of the engine, and an atmospheric pressure sensor 42 for detecting the atmospheric pressure Pa (kPa) are attached to the intake duct 13 upstream of the throttle valve 17. The air flow meter 41 has a built-in atmospheric temperature sensor for detecting the atmospheric temperature Ta (K). Also, an accelerator pedal 43 is connected with a load sensor 44 for detecting a depression ACC of the accelerator pedal 43. The depression ACC of the accelerator pedal 43 represents a required load. The output voltages of the sensors 40, 41, 42 and 44 are input through the corresponding A/D converter 37 to the input port 35. Further, the input port 35 is connected with a crank angle sensor 45 for generating an output pulse for each rotation of 30°, for example, of the crankshaft. CPU 34 calculates the engine speed NE based on the output pulse from the crank angle sensor 45. On the other hand, the output port 36 is connected through corresponding drive circuits 38 to the spark plug 10, the fuel injectors 15, and the step motor 16, which are controlled based on the output signals from the electronic control unit 30. Note that a flow rate of intake air to be detected by the air flow meter 41 is referred to as an air flow meter-detecting air flow rate mtafm (gram/sec), hereinafter.

In the internal combustion engine shown in FIG. 1, a fuel injection amount QF is calculated based on the following equation (1), for example:

$$QF=kAF\cdot KL \tag{1}$$

where kAF represents a coefficient for setting an air-fuel ratio, and KL represents an engine load ratio (%).

The coefficient for setting an air-fuel ratio kAF is a coefficient representing a target air-fuel ratio. The coefficient kAF becomes larger when the target air-fuel ratio is made larger or leaner, and becomes smaller when the target air-fuel ratio is made smaller or richer. The coefficient kAF is stored in the ROM 32 in advance as a function of the engine operating condition such as the required engine load and the engine speed.

On the other hand, the engine load ratio KL represents an amount of air charged in each cylinder, and is defined by the following equation (2), for example:

$$KL = \frac{Mc}{\frac{DSP}{NCYL}\cdot \rho astd}\cdot 100 \tag{2}$$

where Mc represents an in-cylinder charged air amount (gram) which is an amount of air having been charged into each cylinder when the intake stroke is completed; DSP represents the displacement of the engine (liter); NCYL represents the number of cylinders; and ρastd represents density of air (=approximately 1.2 g/liter) at standard conditions (1 atm and 25° C.). By replacing these coefficients together with kk, the in-cylinder charged air amount Mc can be expressed by the following equation (3):

$$Mc = \frac{KL}{kk} \tag{3}$$

Further, if a flow rate of air sucked from the intake pipe IM into the cylinder is referred to as an in-cylinder intake air flow rate mc (gram/sec) and the in-cylinder intake air flow rate mc at the closing timing of the intake valve is referred to as a closing-timing in-cylinder intake air flow rate mcfwd (gram/sec), the in-cylinder charged air amount Mc can also be expressed by the following equation (4):

$$Mc=mcfwd\cdot tiv \tag{4}$$

where tiv represent a time period (sec) required for each cylinder to conduct one intake stroke.

Therefore, in order to make an air-fuel ratio equal to a target air-fuel ratio accurately, it is necessary to accurately obtain any one of the engine load ratio KL, the in-cylinder charged air amount Mc and the closing-timing in-cylinder intake air flow rate mcfwd. In the following description, a case in that the closing-timing in-cylinder intake air flow rate mcfwd is obtained will be explained. Note that considering that the closing timing of the intake valve comes after a certain time tfwd from the current or calculation timing, it can be said that the embodiment of present invention predicts the in-cylinder intake air flow rate preceding by tfwd.

Figure 2:
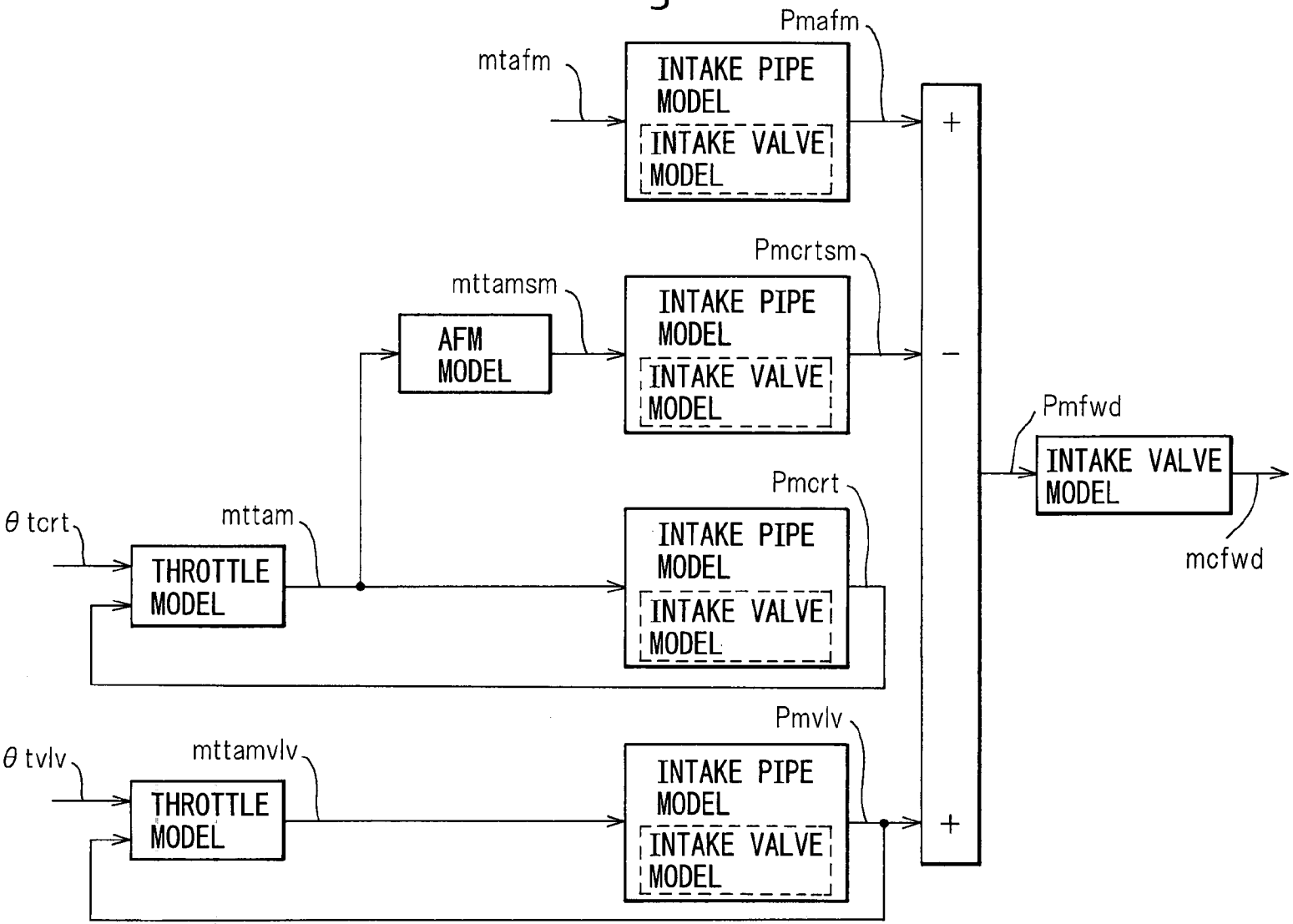
FIG. 2 shows a diagram for explaining an embodiment of the present invention.

Next, referring to FIG. 2 as well as FIGS. 3 and 4, a method of predicting the closing-timing in-cylinder intake air flow rate mcfwd according to the embodiment of the present invention will be explained roughly.

If a pressure in the intake pipe IM is referred to as an intake pipe pressure Pm (kPa) and an intake pipe pressure Pm at the closing timing of the intake valve is referred to as a closing-timing intake pipe pressure Pmfwd (kPa), in the embodiment of the present invention, the closing-timing intake pipe pressure Pmfwd is first predicted and the closing-timing in-cylinder intake air flow rate mcfwd is then predicted from the predicted closing-timing intake pipe pressure Pmfwd and an intake valve model.

The closing-timing intake pipe pressure Pmfwd is calculated based on the following equation (5):

$$Pmfwd=Pmvlv+(Pmafm-Pmcrtsm) \quad (5)$$

where Pmvlv represents a provisional closing-timing intake pipe pressure (kPa), Pmafm represents a current intake pipe pressure (kPa) calculated from the air flow meter-detecting air flow rate mtafm, and Pmcrtsm represents a current intake pipe pressure (kPa) calculated from mttamsm which will be explained hereinafter.

The provisional closing-timing intake pipe pressure Pmvlv includes calculation errors, and the errors can be expressed by the difference (Pmafm−Pmcrtsm). Therefore, in the embodiment of the present invention, the provisional closing-timing intake pipe pressure Pmvlv is corrected by the difference (Pmafm−Pmcrtsm) to calculate the final closing-timing intake pipe pressure Pmfwd.

The provisional closing-timing intake pipe pressure Pmvlv is calculated in the following manner. First, a closing-timing throttle opening θtvlv, which is the throttle opening θt at the closing timing of the intake valve, is calculated. If an air flow rate passing through the throttle valve 17 is referred to as a throttle valve passing-through air flow rate mt (gram/sec) and the throttle valve passing-through air flow rate mt at the closing timing of the intake valve is referred to as a closing-timing throttle valve passing-through air flow rate mttamvlv (gram/sec), mttamvlv is then calculated from the closing-timing throttle opening θtvlv, Pmvlv calculated in the previous processing cycle, and the throttle model. The provisional closing-timing intake pipe pressure Pmvlv is then calculated from the closing-timing throttle valve passing-through air flow rate mttamvlv and the intake pipe model.

On the other hand, the current intake pipe pressure Pmcrtsm calculated from mttamsm is calculated in the following manner. First, a current value mttam of the throttle valve passing-through air flow rate calculated from the current throttle opening θtcrt is calculated from the current throttle opening θtcrt detected by the throttle opening sensor 40, Pmcrt (explained later) calculated in the previous processing cycle, and the throttle model. Then, mttamsm, which represents a current air flow meter-detecting air flow rate (gram/sec) assuming that air flows through the intake passage by the above-mentioned mttam, is calculated from mttam and an AFM (air flow meter) model. Then, Pmcrtsm is calculated from mttamsm and the intake pipe model. In addition, Pmcrt, which represents a current intake pipe pressure (kPa) calculated from mttam, is calculated from the above-mentioned mttam and the intake pipe model.

Further, Pmafm is calculated from the air flow meter-detecting air flow rate mtafm and the intake pipe model.

In this manner, in the embodiment according to the present invention, the closing-timing in-cylinder intake air flow rate mcfwd is calculated using the calculation models such as the throttle model, the AFM model, the intake pipe model, and the intake valve model. Next, the calculation models will be explained.

First, the throttle model will be explained. The throttle model is used to calculate the throttle valve passing-through air flow rate mt.

Figure 3:
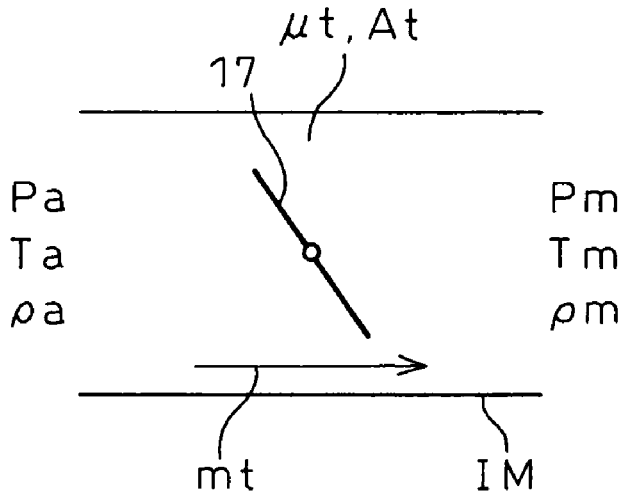
FIG. 3 shows a diagram for explaining a throttle model.
Figure 4:
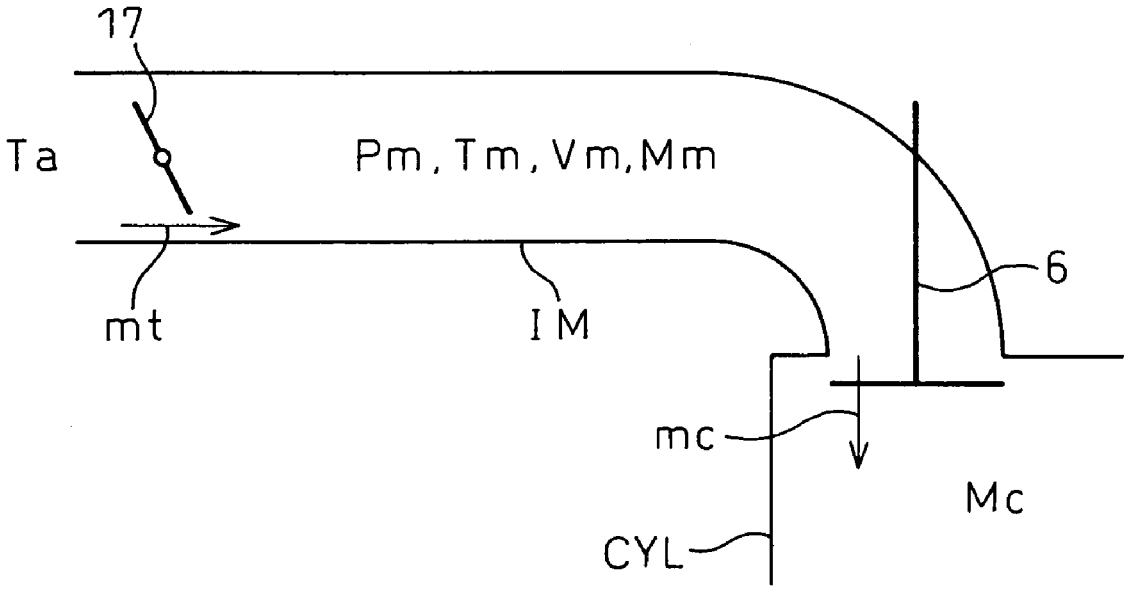
FIG. 4 shows a diagram for explaining an intake pipe model.

As shown in FIG. 3, assuming that a pressure and a temperature upstream of the throttle valve 17 are the atmospheric pressure Pa and the atmospheric temperature Ta, respectively, and that a pressure and a temperature downstream of the throttle valve 17 are the intake pipe pressure Pm and the intake pipe temperature Tm, respectively, the throttle valve passing-through air flow rate mt is expressed by the following equation (6), using the linear velocity vt (m/sec) of air passing through the throttle valve:

$$mt=\mu t\cdot At\cdot vt\cdot \rho m \quad (6)$$

where, μt represents a flow coefficient at the throttle valve 17, At represents an opening area ($m^2$) of the throttle valve 17, ρm represents density ($kg/m^3$) of air downstream of the throttle valve 17 or in the intake pipe IM.

Further, the energy conservation law regarding air upstream and downstream of the throttle valve 17 is expressed by the following equation (7):

$$\frac{v^2}{2}+Cp\cdot Tm=Cp\cdot Ta \quad (7)$$

where Cp represents the specific heat at a constant air pressure.

Furthermore, considering that, at infinity upstream of the throttle valve 17, the cross sectional area of the intake pipe IM is infinite large and the air flow rate is zero, the momentum conservation law regarding air upstream and downstream the throttle valve 17 is expressed by the following equation (8):

$$\rho m\cdot v^2=Pa-Pm \quad (8)$$

Accordingly, the throttle valve passing-through air flow rate mt is expressed by the following equation (9) from the state equation at the upstream of the throttle valve 17 (Pa=ρa·R·Ta, where ρa represents density ($kg/m^3$) of air at the upstream of the throttle valve 17 or in the atmosphere, and R represents the gas constant), the state equation at the downstream of the throttle valve 17 (Pm=ρm·R·Tm), and the above-mentioned equations (6), (7), and (8):

$$mt=\mu t\cdot At\cdot\frac{Pa}{\sqrt{R\cdot Ta}}\cdot\Phi\left(\frac{Pm}{Pa}\right) \quad (9)$$

$$\Phi\left(\frac{Pm}{Pa}\right)=\begin{cases}\sqrt{\dfrac{\kappa}{2\cdot(\kappa+1)}} & \cdots\dfrac{Pm}{Pa}\le\dfrac{1}{\kappa+1}\\[2ex] \sqrt{\left\{\dfrac{\kappa-1}{2\cdot\kappa}\cdot\left(1-\dfrac{Pm}{Pa}\right)+\dfrac{Pm}{Pa}\right\}\cdot\left(1-\dfrac{Pm}{Pa}\right)} & \cdots\dfrac{Pm}{Pa}>\dfrac{1}{\kappa+1}\end{cases}$$

Figure 5A:
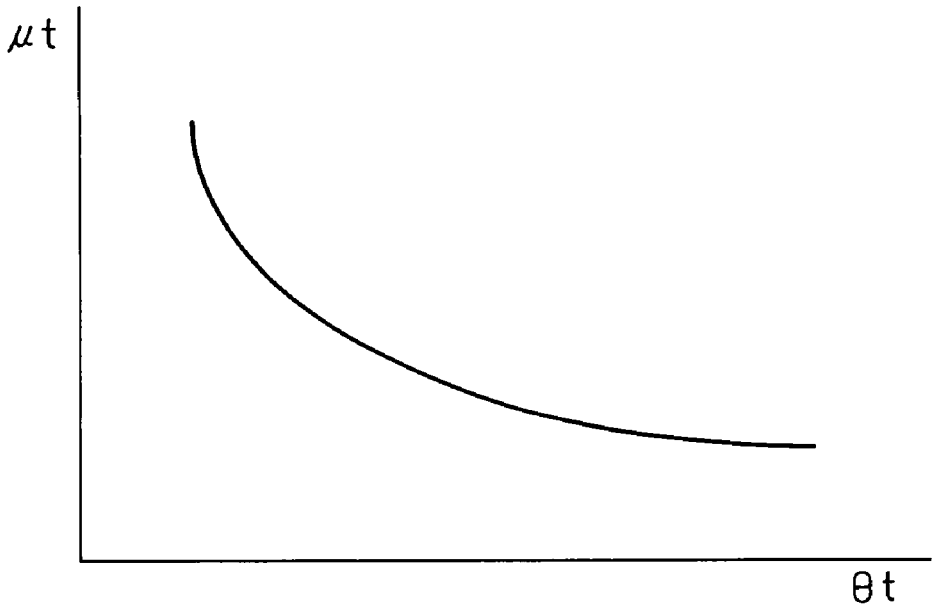
FIGS. 5A and 5B show diagrams illustrating a flow coefficient μt and an opening area At of a throttle valve, respectively.
Figure 5B:
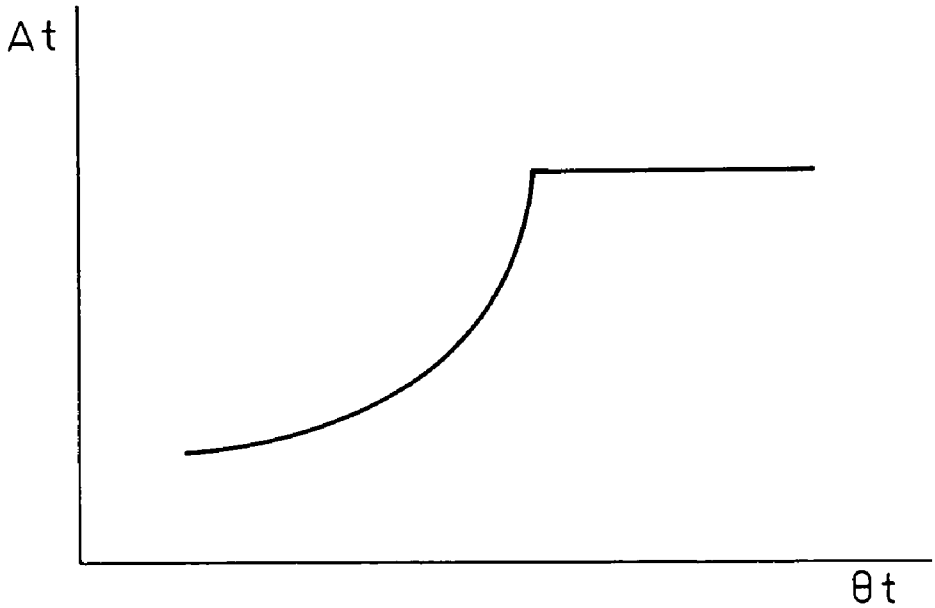

Note that the flow coefficient μt and opening area At are obtained from experiments in advance as a function of the throttle opening θt, and are stored in the ROM 32 in the form of maps as shown in FIGS. 5A and 5B, respectively.

When mttamvlv should be calculated, (mttamvlv, θtvlv, Pmvlv) are substituted for (mt, θt, Pm) in the throttle model. When mttam should be calculated, (mttam, θtcrt, Pmcrt) are substituted for (mt, θt, Pm) in the throttle model.

A method of estimating the closing-timing throttle opening θtvlv will be explained briefly. In the embodiment according to the present invention, a basic target throttle opening is calculated based on the depression ACC of the accelerator pedal 43. After a predetermined delay time has passed, the target throttle opening is set to the basic target throttle opening and the throttle valve 17 is controlled to make the actual throttle opening equal to the target throttle opening. In other words, the change of the target throttle opening is delayed by the delay time from the change of the depression of the accelerator pedal 43. This makes possible to find how to change the actual throttle opening θt from now to the timing after the delay time has passed, since the current throttle opening and the target throttle opening after the delay time has passed from now have been obtained. Therefore, the closing-timing throttle opening θtvlv can be estimated. Note that the delay time is set longer than a time which the above-mentioned time tfwd can be.

Next, the intake pipe model will be explained. The intake pipe model is used to calculate the intake pipe pressure Pm, the intake pipe temperature Tm, and a pressure-temperature ratio PBYT (=Pm/Tm).

The intake pipe model of the embodiment according to the present invention focuses on the mass conservation law and the energy conservation law regarding the intake pipe IM. Specifically, the flow rate of air entering the intake pipe IM is equal to the throttle valve passing-through air flow rate mt and the flow rate of air exiting from the intake pipe IM is equal to the in-cylinder intake air flow rate mc, as shown in FIG. 4, and therefore, the mass conservation law and the energy conservation law regarding the intake pipe IM are expressed by the following equations (10) and (11), respectively:

$$\frac{dMm}{dt} = mt - mc \tag{10}$$

$$\frac{d(Mm \cdot Cv \cdot Tm)}{dt} = Cp \cdot mt \cdot Ta - Cp \cdot mc \cdot Tm \tag{11}$$

where Mm represents an amount of air (gram) existing in the intake pipe IM, t represents time, Vm represents a volume ($m^3$) of the intake pipe IM, and Cv represents the specific heat at constant volume of air.

The equations (10) and (11) can be rewritten to the following equations (12) and (13), respectively, using the state equation (Pm·Vm=Mm·R·Tm), Mayer's relation (Cp=Cv+R), and the specific heat ratio κ (=Cp/Cv):

$$\frac{dPBYT}{dt} = \frac{R}{Vm} \cdot (mt - mc) \tag{12}$$

$$\frac{dPm}{dt} = \kappa \cdot \frac{R}{Vm} \cdot (mt \cdot Ta - mc \cdot Tm) \tag{13}$$

Therefore, the pressure-temperature ratio PBYT and the intake pipe pressure Pm can be calculated by sequentially solving the equations (12) and (13), respectively, and the intake pipe temperature Tm can also be calculated (Tm=Pm/PBYT). In the actual calculation, the equations (12) and (13) are expressed as in the equations (14) and (15), respectively, using the time interval of calculation Δt and a parameter i expressing the number of calculation cycle:

$$PBYT(i) = PBYT(i-1) + \Delta t \cdot \frac{R}{Vm} \cdot (mt(i-1) - mc(i-1)) \tag{14}$$

$$Pm(i) = Pm(i-1) + \Delta t \cdot \kappa \cdot \frac{R}{Vm} \cdot (mt(i-1) \cdot Ta - mc(i-1) \cdot Tm(i-1)) \tag{15}$$

In these equations, the specific heat ratio κ, the gas constant R, and the volume Vm of the intake pipe IM are constant, and the atmospheric temperature Ta is detected by the atmospheric temperature sensor.

The in-cylinder intake air flow rate mc in the equations (12) and (13) or the equations (14) and (15) is calculated using the intake valve model. Next, the intake valve model will be explained.

It has been experimentally and theoretically proved that there is a linear relationship between the in-cylinder intake air flow rate mc and the intake pipe pressure Pm. Thus, in the intake valve model of the embodiment according to the present invention, the in-cylinder intake air flow rate mc is calculated using the following equation (16):

$$mc = \frac{Ta}{Tm} \cdot (ka \cdot Pm - kb) \tag{16}$$

where ka and kb are constants set in accordance with the engine operating condition such as the engine speed.

When Pmvlv should be calculated, (mttamvlv, mcvlv, Pmvlv, Tmvlv) are substituted for (mt, mc, Pm, Tm) in the intake pipe model and the intake valve model, where mcvlv and Tmvlv represent the in-cylinder intake air flow rate at the closing timing of the intake valve and the intake pipe temperature at the closing timing of the intake valve, both of which are calculated from mttamvlv, respectively. When Pmcrt should be calculated, (mttam, mccrt, Pmcrt, Tmcrt) are substituted for (mt, mc, Pm, Tm) in the intake pipe model and the intake valve model, where mccrt and Tmcrt represent the current in-cylinder intake air flow rate and the current intake pipe temperature, both of which are calculated from mttam, respectively. When Pmcrtsm should be calculated, (mttamsm, mccrtsm, Pmcrtsm, Tmcrtsm) are substituted for (mt, mc, Pm, Tm) in the intake pipe model and the intake valve model, where mccrtsm and Tmcrtsm represent the current in-cylinder intake air flow rate and the current intake pipe temperature, both of which are calculated from mttamsm, respectively. When Pmafm should be calculated, (mtafm, mcafm, Pmafm, Tmafm) are substituted for (mt, mc, Pm, Tm) in the intake pipe model and the intake valve model, where mcafm and Tmafm represent the current in-cylinder intake air flow rate and the current intake pipe temperature, both of which are calculated from mtafm, respectively.

As mentioned above, the intake valve model is used also to calculate the final closing-timing in-cylinder intake air flow rate mcfwd. In this case, (mcfwd, Pmfwd, Tmfwd) are substituted for (mc, Pm, Tm), where Tmfwd represents the intake pipe temperature at the closing timing of the intake valve.

Next, the AFM model will be explained. The AFM model is used to calculate mttamsm.

Figure 6A:
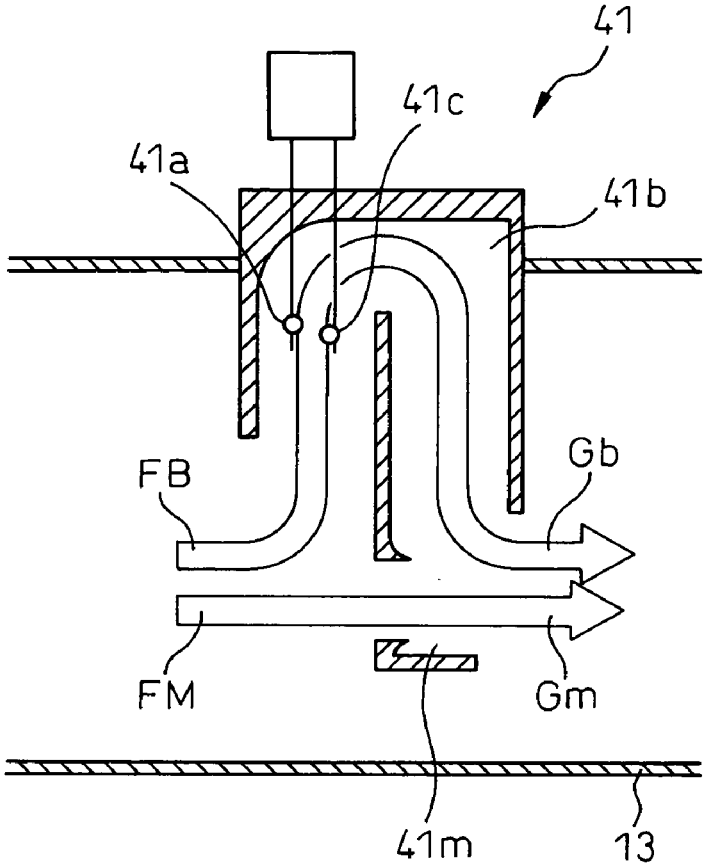
FIGS. 6A and 6B show details of an air flow meter.
Figure 6B:
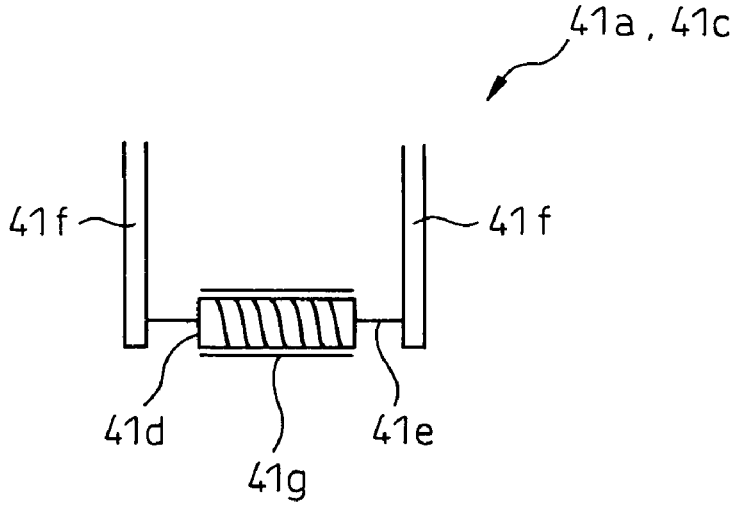

The air flow meter 41 will first be explained. As shown in FIG. 6A, the air flow meter 41 is of a flow dividing type, which has a bypass passage 41*b* through which a part of air flowing through the intake duct 13 is introduced. In this case, the air flowing through the intake duct 13 is constituted by a bypass flow FB flowing through the bypass passage 41*b* and a main flow FM flowing through a main passage 41*m* other than the bypass passage 41*b*. The air flow rate of the main flow FM corresponds to the flow rate of air flowing through the intake duct 13 or the throttle valve passing-through air flow rate mt. The air flow meter 41 further comprises a resistance 41*a* for detecting the intake air temperature and a heating resistance 41*c*, both arranged in the bypass passage 41*b*. As shown in FIG. 6B, each resistance 41*a*, 41*c* comprises a bobbin 41*d* of alumina around which a platinum wire is wound, and the bobbin 41*d* is supported by support bodies 41*f* via wire leads 41*e*. Further, the bobbin 41*d* is covered by a glass coating 41*g*. A voltage is applied to the heating resistance 41*c* to maintain the difference between the temperatures of the detecting resistance 41*a* and the heating resistance 41*c* at constant. Thus, for example, when the amount of air flowing through the intake duct 13 increases and the heat radiation amount from the heating resistance 41*c* to the surrounding air increases, the voltage applied to the heating resistance 41*c* increases by the increase of the air amount. Therefore, the amount of air flowing through the intake duct 13 can be found on the basis of the voltage applied to the heating resistance 41*c* or the output voltage from the air flow meter 41.

There is a lag in heat radiation from the heating resistance 41*c* to the air due to heat conduction between the air and the bobbin 41*d* and between the air and the support bodies 41*f*, and thus there may be a response lag in the output of the air flow meter 41. Therefore, the AFM model of the embodiment according to the present invention considers that heat radiation from the heating resistance 41*c* is constituted by heat radiation from the bobbin 41*d* and that from the support bodies 41*f*, and focuses on the heat radiation amounts from the bobbin 41*d* and the support bodies 41*f*.

If the heat radiation amounts from the bobbin 41*d* and the support bodies 41*f*, assuming that there is no response lag, are referred to as true heat radiation amounts W1, W2, respectively, and the heat radiation amounts from the bobbin 41*d* and the support bodies 41*f* with response lag are referred to as response heat radiation amounts w1, w2, respectively, the response heat radiation amounts w1, w2 are expressed by the following equations (17) and (18), based on the first order lag process of the true heat radiation amounts W1, W2:

$$\frac{dw1}{dt} = \frac{W1 - w1}{\tau 1} \tag{17}$$

$$\frac{dw2}{dt} = \frac{W2 - w2}{\tau 2} \tag{18}$$

where τ1 represents a time constant regarding the response heat radiation amount w1 of the bobbin 41*d*, and τ2 represents a time constant regarding the response heat radiation amount w2 of the support bodies 41*f*. In the actual calculation, the equations (17) and (18) are expressed by the equations (19) and (20), respectively, using the time interval of calculation Δt and a parameter i expressing the number of calculation cycle:

$$w1(i) = \Delta t \cdot \frac{W1(i) - w1(i)}{\tau 1} + w1(i-1) \tag{19}$$

$$w2(i) = \Delta t \cdot \frac{W2(i) - w2(i)}{\tau 2} + w2(i-1) \tag{20}$$

The time constants τ1, τ2 are calculated from, for example, the following equations (21) and (22), respectively:

$$\tau 1 = kw1 \cdot Ub^{m1} \tag{21}$$

$$\tau 2 = kw2 \cdot Ub^{m2} \tag{22}$$

where Ub represents a bypass flow rate which is a linear velocity (m/sec) of the bypass flow FB, and kw1, kw2, m1, and m2 represent constants, respectively.

In the AFM model in the embodiment according to the present invention, the air flow meter-detecting air flow rate Gm (gram/sec) assuming that the flow rate of air flowing through the intake duct 13 is equal to G (gram/sec) is calculated. Next, a method of calculating the air flow meter-detecting air flow rate Gm will be explained.

Figure 7A:
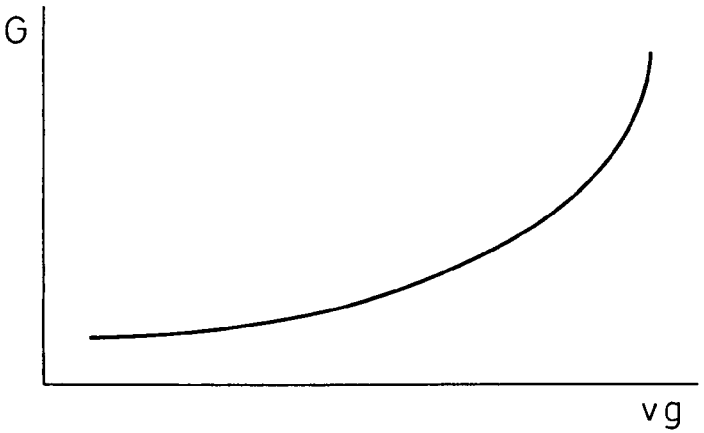
FIGS. 7A–7D show diagrams illustrating an air flow rate G, a bypass flow rate Ub, and an air flow rate Gm.
Figure 7B:
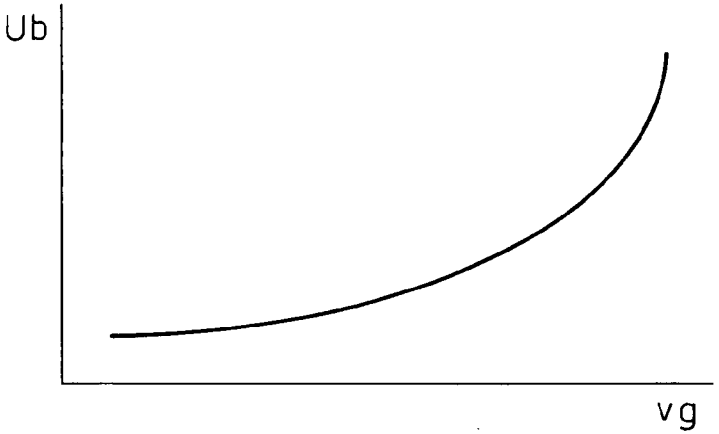

First, the time constants τ1, τ2 are calculated. Specifically, if an output voltage of the air flow meter 41 is referred to an air flow meter output voltage vg, the air flow meter output voltage vg assuming that flow rate of air flowing through the intake duct 13 is equal to G is calculated. The relationships between the air flow rate G and the air flow meter output voltage vg are obtained in advance in the form of the map as shown in FIG. 7A, and are stored in the ROM 32. Then, the bypass flow rate Ub, assuming that the air flow meter output voltage is equal to vg, is calculated. The relationships between the air flow meter output voltage vg and the bypass flow rate Ub are obtained in advance in the form of the map as shown in FIG. 7B, and are stored in the ROM 32. Then, the time constants τ1, τ2 are calculated from the equations (21) and (22), respectively.

Figure 7C:
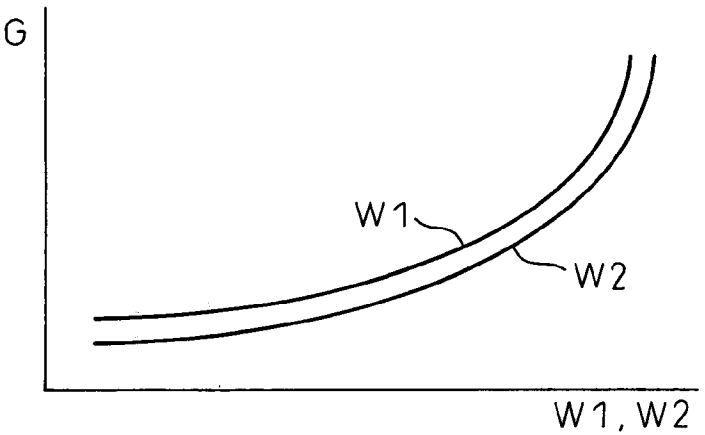
Figure 7D:
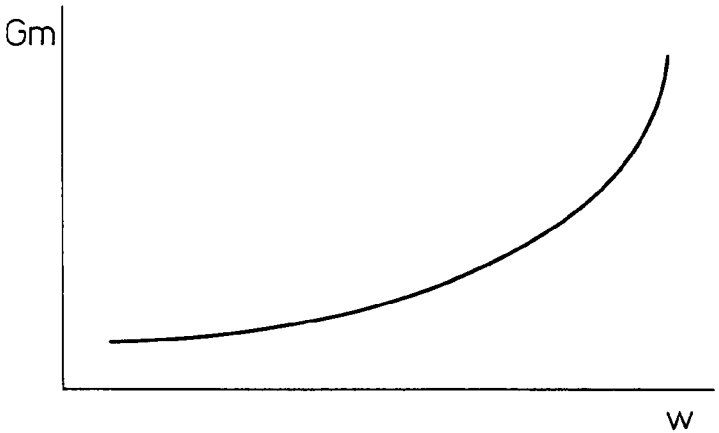

After that, the true heat radiation amounts W1, W2 from the bobbin 41*d* and the support bodies 41*f* assuming that the flow rate of air flowing through the intake duct 13 is equal to G are calculated from the map shown in FIG. 7C. The relationships between the air flow rate G and the true heat radiation amounts W1, W2 are obtained in advance in the form of the map as shown in FIG. 7C, and are stored in the ROM 32. Then, the response heat radiation amounts w1, w2 are calculated from the equations (19) and (20), respectively. Then, a total response heat radiation amount w, which is equal to a sum of the response heat radiation amounts w1 and w2 (w=w1+w2), is calculated. Then, the air flow meter-detecting air flow rate Gm is calculated. The relationships between the total response heat radiation amount w and the air flow rate Gm are obtained in advance in the form of the map as shown in FIG. 7D, and are stored in the ROM 32.

When mttamsm should be calculated, (mttam, mttamsm) are substituted for (G, Gm) in the AFM model.

The air flow meter-detecting air flow rate mtafm as mentioned above is calculated from the map shown in FIG. 7A. Specifically, the air flow rate G is calculated from the actual air flow meter output voltage vg, and is substituted for the air flow meter-detecting air flow rate mtafm.

As can be understood from the above, both of mttamsm calculated from the AFM model and the air flow meter-detecting air flow rate mtafm include the response lags, and the response of mttamsm and mtafm are made identical. Thus, the response of Pmcrtsm calculated from mttamsm and Pmafm calculated from mtafm are also made identical. Therefore, the difference between Pmafm and Pmcrtsm (=Pmafm−Pmcrtsm) represents the errors of the calculation model. Accordingly, Pmfwd calculated from the equation (5) accurately expresses the closing-timing intake pipe pressure.

However, the flow area of the bypass passage 41*b* of the air flow meter 41 is small and thus there may be a case in which the pressure loss of the bypass passage 41*b* cannot be ignored. However, the AFM model mentioned above does not consider the pressure loss of the bypass passage 41*b* and, therefore, there may be a case in which mttamsm and Pmcrtsm cannot be obtained accurately.

The pressure loss of the bypass passage 41*b* should be considered when a rapid acceleration of the engine is in process where the throttle valve passing-through air flow rate increases widely. However, when the engine operation other than the rapid acceleration such as a slow acceleration is in process, a consideration of the pressure loss of the bypass passage 41*b* may excessively correct mttamsm.

Accordingly, in the embodiment according to the present invention, mttamsm is calculated from mttam considering the pressure loss of the bypass passage 41*b* when the rapid acceleration of the engine is in process, and is calculated from mttam ignoring the pressure loss when the engine operation other than rapid acceleration is in process.

If the flow rate of the main flow FM is expressed by Um (m/sec) and the bypass flow rate considering the pressure loss of the bypass passage 41*b* is expressed by Ubp (m/sec), the following equations (23) and (24) are established regarding the main flow FM and the bypass flow FB, respectively:

$$\frac{\Delta P}{\rho} = Lm \cdot \frac{dUm}{dt} + Cm \cdot Um^2 \tag{23}$$

$$\frac{\Delta P}{\rho} = Lb \cdot \frac{dUbp}{dt} + Cb \cdot Ubp^2 \tag{24}$$

where ΔP represents the pressure difference between the upstream and downstream of the air flow meter 41, ρ represents density of air around the air flow meter 41, Lm and Lb represent lengths of the main passage 41*m* and the bypass passage 41*b*, respectively, and Cm and Cb represent loss coefficients of the main passage 41*m* and the bypass passage 41*b*, respectively.

In this case, the above-mentioned Ub represents the bypass flow rate ignoring the pressure loss of the bypass passage 41.

In the equations (23) and (24), it is assumed that the following equations (25) and (26) are established:

$$\frac{dUm}{dt} = kaa \cdot \frac{dUb}{dt} \tag{25}$$

$$\frac{dUbp}{dt} = kbb \cdot \frac{dUb}{dt} \tag{26}$$

where kaa and kbb are constants. In addition, the following equation (27) is established:

$$Cb \cdot Ub^2 = Cm \cdot Um \tag{27}$$

Therefore, the bypass flow rate Ubp considering the pressure loss of the bypass passage 41*b* is expressed by the following equation (28):

$$Ubp = \left\{ Ub^2 - \frac{Lb \cdot kbb - Lm \cdot kaa}{Cb} \cdot \frac{dUb}{dt} \right\}^{1/2} \tag{28}$$

Next, a method of calculating mttamsm considering the pressure loss of the bypass passage 41*b* will be explained.

First, the air flow meter output voltage vg, assuming that the flow rate of air flowing through the intake duct 13 is equal to G, is calculated from the map shown in FIG. 7A. Then, the bypass flow rate Ub, assuming that the air flow meter output voltage is equal to vg and ignoring the pressure loss of the bypass passage 41*b*, is calculated from the map shown in FIG. 7B. Then, the bypass flow rate Ubp, considering the pressure loss of the bypass passage 41*b*, is calculated from the above-mentioned equation (28). Then, the air flow meter output voltage vgp, assuming that the bypass flow rate is equal to Ubp, is calculated from the map shown in FIG. 7B. Then, the flow rate Gp of air flowing through the intake duct 13, assuming that the air flow meter output voltage is equal to vgp, is calculated from the map shown in FIG. 7A. Then, this Gp is substituted for G, and Gm is then calculated from G and the AFM model. The time constants τ1, τ2 in this case are calculated from the equations (21) and (22), respectively, after Ubp is substituted for Ub.

Figure 8:
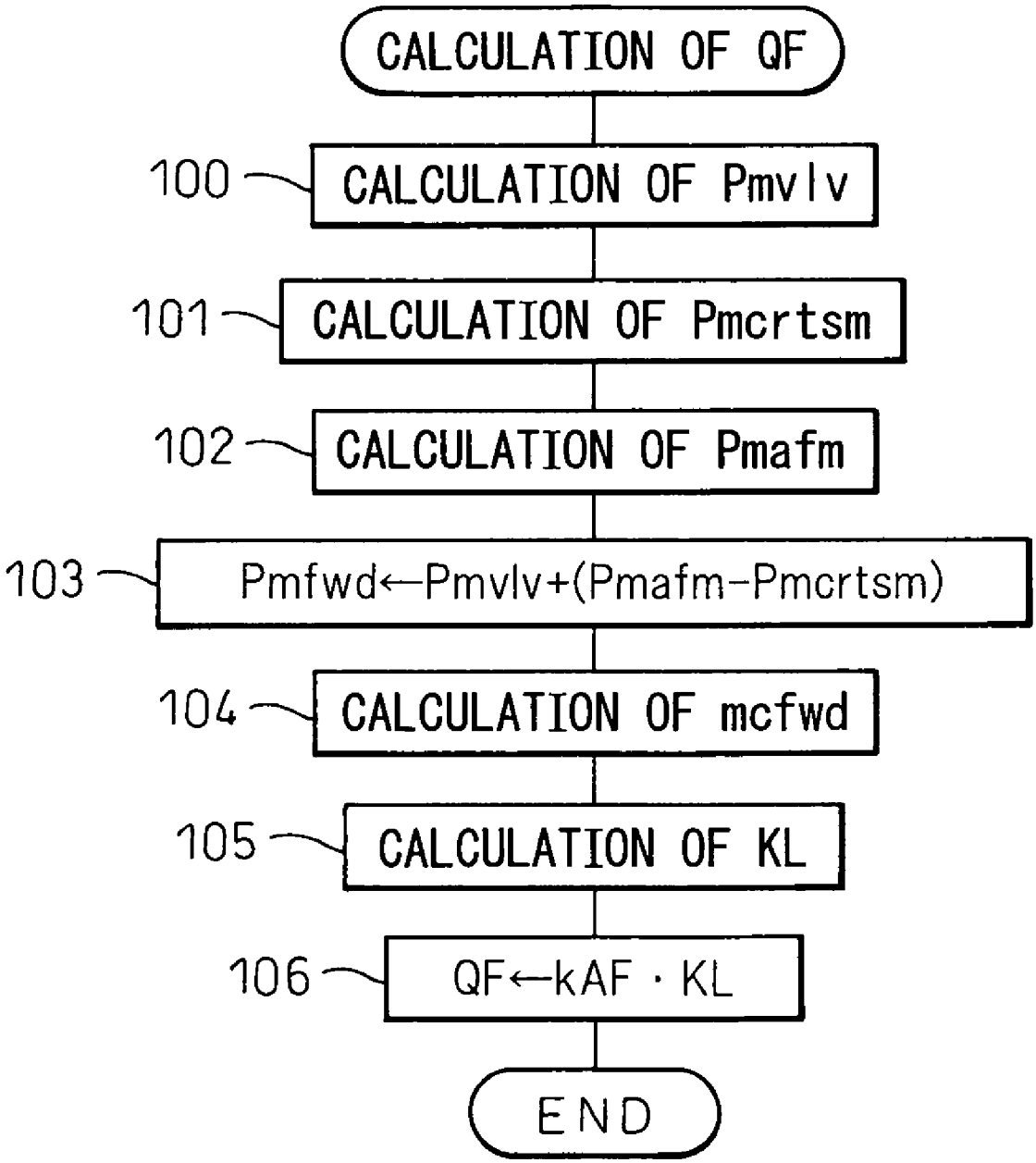
FIG. 8 shows a flowchart illustrating a routine for calculating a fuel injection amount QF.

FIG. 8 shows a calculation routine of the fuel injection amount QF according to the embodiments of the present invention. This routine is executed by interruption every predetermined time.

Referring to FIG. 8, first, in step 100, Pmvlv is calculated. In the following step 101, Pmcrtsm is calculated. In the following step 102, Pmafm is calculated. In the following step 103, the closing-timing intake pipe pressure Pmfwd is calculated. In the following step 104, the closing-timing in-cylinder intake air flow rate mcfwd is calculated. In the following step 105, the engine load ratio KL is calculated. In the following step 106, the fuel injection amount QF is calculated.

Figure 9:
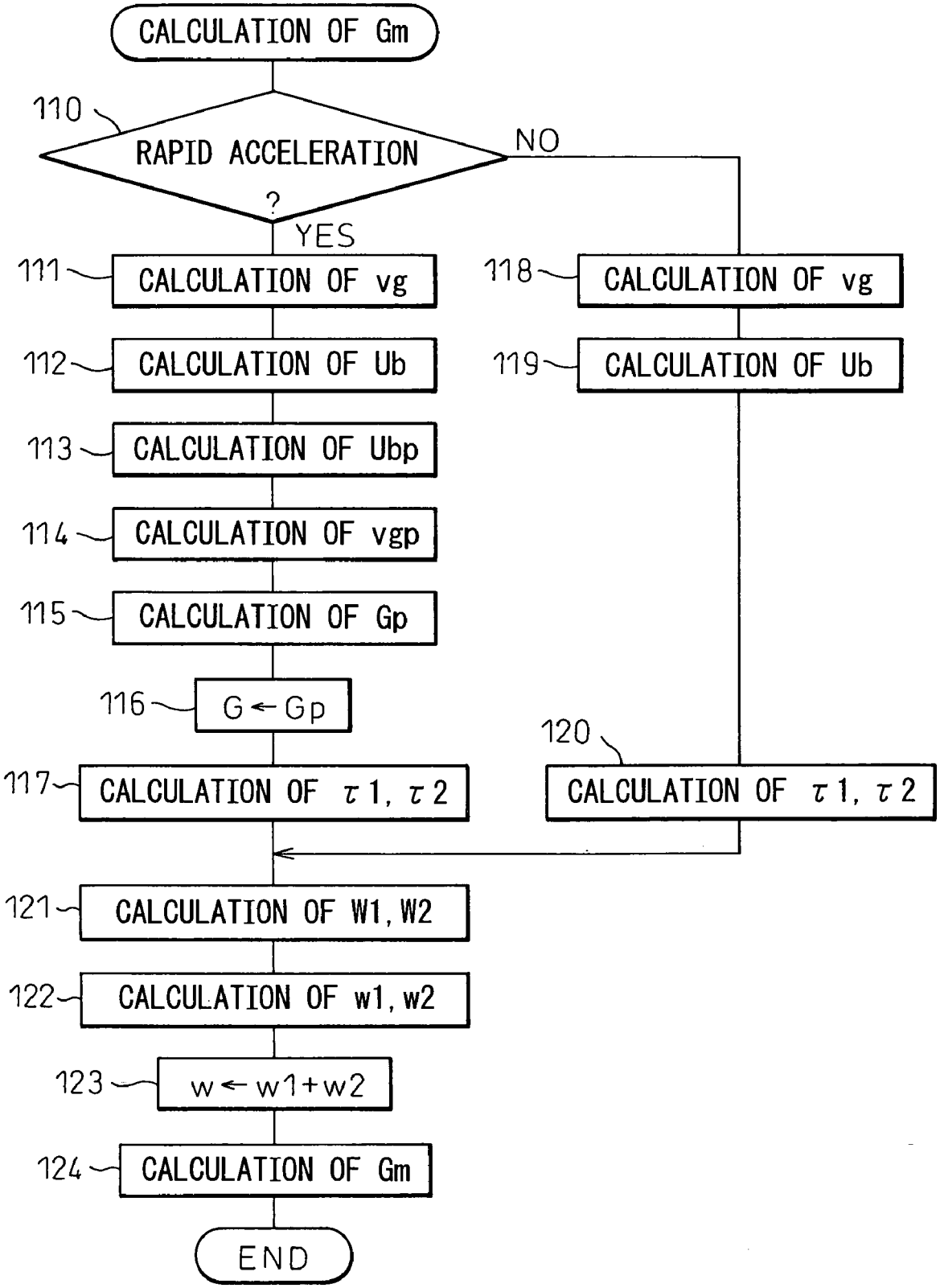
FIG. 9 shows a flowchart illustrating a routine for calculating an air flow rate Gm.

FIG. 9 shows a calculation routine of the air flow rate Gm according to the embodiments of the present invention. This routine is executed in step 101 shown in FIG. 8.

Referring to FIG. 9, in step 110, it is judged whether the rapid acceleration of the engine is in process. When the rapid acceleration of the engine is in process or the degree of acceleration is larger than a predetermined value, the routine goes to step 111, where the air flow meter output voltage vg, assuming that the flow rate of air flowing through the intake duct 13 is equal to G, is calculated from the map shown in FIG. 7A. In the following step 112, the bypass flow rate Ub, assuming that the air flow meter output voltage is equal to vg and ignoring the pressure loss of the bypass passage 41*b*, is calculated from the map shown in FIG. 7B. In the following step 113, the bypass flow rate Ubp, considering the pressure loss of the bypass passage 41*b*, is calculated from the equation (28). In the following step 114, the air flow meter output voltage vgp, assuming that the bypass flow rate is equal to Ubp, is calculated from the map shown in FIG. 7B. In the following step 115, the flow rate Gp of air flowing through the intake duct 13, assuming that the air flow meter output voltage is equal to vgp, is calculated from the map shown in FIG. 7A. In the following step 116, this Gp is substituted for G. In the following step 117, the time constants τ1, τ2 are calculated from the bypass flow rate Ubp considering the pressure loss of the bypass passage 41*b*. Then, the processing cycle goes to step 121.

In contrast, when the rapid acceleration of the engine is not in process, the routine goes from step 110 to step 118, where the air flow meter output voltage vg, assuming that the flow rate of air flowing through the intake duct 13 is equal to G, is calculated from the map shown in FIG. 7A. In the following step 119, the bypass flow rate Ub, assuming that the air flow meter output voltage is equal to vg and ignoring the pressure loss of the bypass passage 41*b*, is calculated from the map shown in FIG. 7B. In the following step 120, the time constants τ1, τ2 are calculated from the bypass flow rate Ub ignoring the pressure loss of the bypass passage 41*b*. Then, the processing cycle goes to step 121.

In step 121, the true heat radiation amounts W1, W2 from the bobbin 41*d* and the support bodies 41*f*, assuming that the flow rate of air flowing through the intake duct 13 is equal to G, are calculated from the map shown in FIG. 7C, respectively. In the following step 122, the response heat radiation amounts w1, w2 are calculated from the equations (19) and (20), respectively. In the following step 123, the total response heat radiation amount w (=w1+w2) is calculated. In the following step 124, the air flow meter-detecting air flow rate Gm is calculated from the map shown in FIG. 7D. This Gm is substituted for mttamsm.

Figure 10:
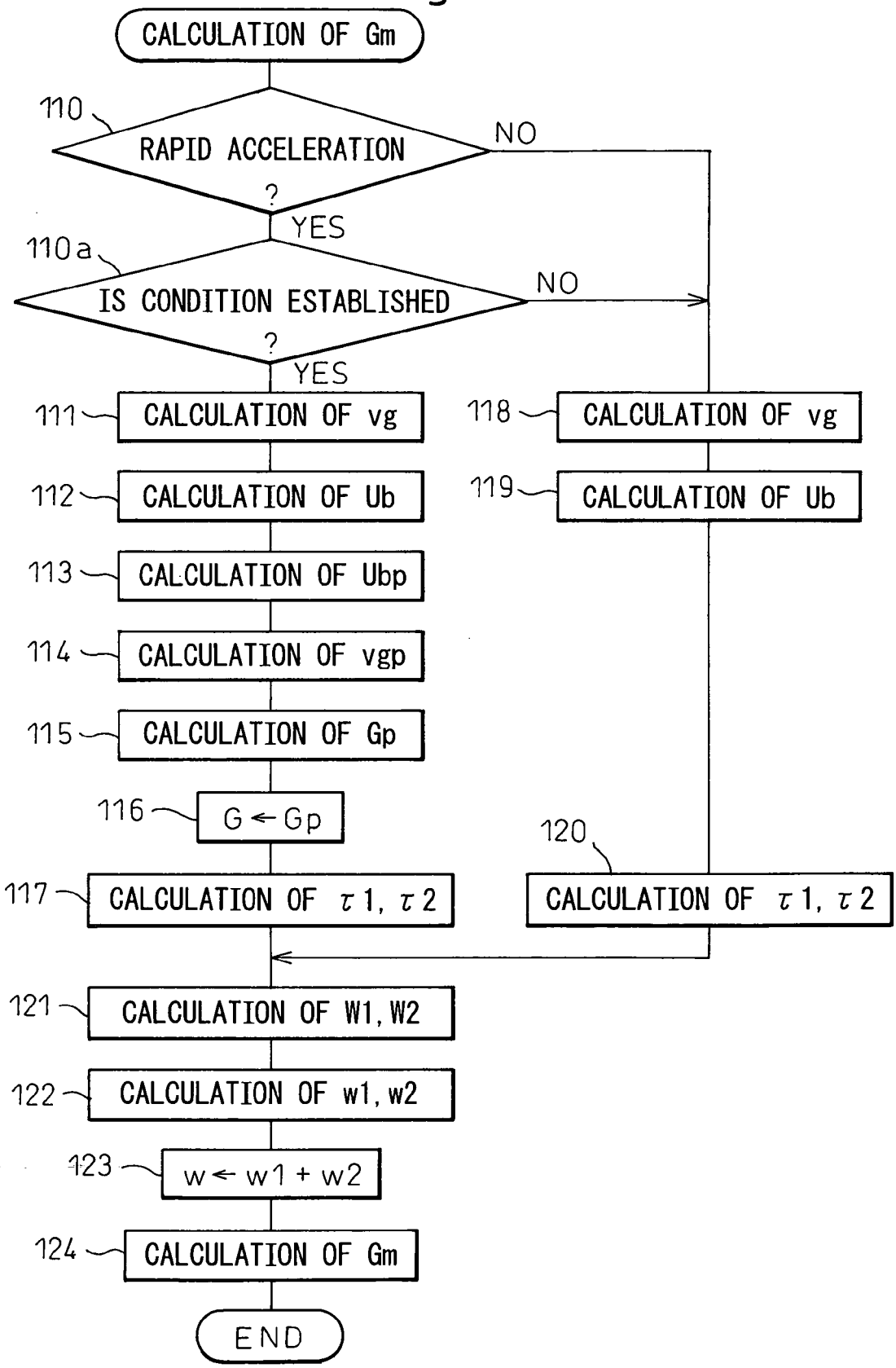
FIG. 10 shows a flowchart illustrating a routine for calculating an air flow rate Gm, according to the alternative embodiment of the present invention.

In the embodiment mentioned above, the air flow meter-detecting air flow rate is estimated considering the pressure loss of the bypass passage 41*b* when the rapid acceleration of the engine is in process. Alternatively, the air flow meter-detecting air flow rate may be estimated considering the pressure loss when the rapid acceleration of the engine is in process and a specific condition is established. Specifically, as shown in FIG. 10, if it is judged in step 110 that the rapid acceleration is in process and it is then judged in step 110*a* that the specific condition is established, the routine goes to steps 111 to 117 to thereby estimate the air flow meter-detecting air flow rate considering the pressure loss. Contrarily, if it is judged in step 110*a* that the specific condition is not established, the routine goes to steps 118 to 120 to thereby estimate the air flow meter-detecting air flow rate by ignoring the pressure loss. In this case, it may be judged that the specific condition is established when the engine speed and the engine load are lower than respective preset values. In other words, the air flow meter-detecting air flow rate, considering the pressure loss, is estimated when the rapid acceleration, the low-speed engine operation, and the low-load engine operation are simultaneously in process, and the air flow meter-detecting air flow rate ignoring the pressure loss is estimated when at least one of the rapid acceleration, the low-speed engine operation, and the low-load engine operation is not in process.

According to the present invention, it is possible to provide a control device for an internal combustion engine, capable of obtaining the in-cylinder intake air amount at the closing timing of the intake valve accurately, and conducting the engine control accurately.

While the invention has been described by reference to specific embodiments chosen for purposes of illustration, it should be apparent that numerous modifications could be made thereto, by those skilled in the art, without departing from the basic concept and scope of the invention.

The invention claimed is:

1. A control device for an internal combustion engine having an intake passage and a throttle valve arranged in the intake passage, comprising:

an air flow meter arranged in the intake passage, the air flow meter including a main passage and a bypass passage and detecting an amount of air flowing through the bypass passage to detect an amount of air flowing through the intake passage;

an obtaining means for obtaining the current throttle opening;

a calculation means for calculating the current intake air amount based on the current throttle opening obtained by the obtaining means;

an estimating means for estimating an air flow meter-detecting intake air amount assuming that air flows through the intake passage by the current intake air amount calculated by the calculation means and considering the pressure loss of the bypass passage of the air flow meter, the air flow meter-detecting intake air amount being an intake air amount to be detected by the air flow meter; and control means for controlling the engine based on the air flow meter-detecting intake air amount estimated by the estimating means.

2. A control device for an internal combustion engine as described in claim 1, wherein the estimating means estimates the air flow meter-detecting intake air amount considering the pressure loss of the bypass passage of the air flow meter when the rapid acceleration of the engine is in process, and estimates the air flow meter-detecting intake air amount ignoring the pressure loss of the bypass passage of the air flow meter when the engine operation other than the rapid acceleration is in process.

3. A control device for an internal combustion engine as described in claim 2, wherein the estimating means estimates the air flow meter-detecting intake air amount considering the pressure loss of the bypass passage of the air flow meter when the rapid acceleration, the low-speed engine operation, and the low-load engine operation are simultaneously in process, and estimates the air flow meter-detecting air flow rate ignoring the pressure loss when at least one of the rapid acceleration, the low-speed engine operation, and the low-load engine operation is not in process.

4. A control device for an internal combustion engine as described in claim 1, wherein an amount of air flowing through the bypass passage of the air flow meter assuming that air flows through the intake passage by the current intake air amount calculated by the calculation means and considering the pressure loss of the bypass passage is estimated, and wherein the air flow meter-detecting intake air amount, assuming that air flows through the intake passage by the current intake air amount calculated by the calculation means and considering the pressure loss of the bypass passage, is estimated based on the estimated amount of air flowing through the bypass passage.

5. A control device for an internal combustion engine as described in claim 4, wherein an amount of air flowing through the bypass passage of the air flow meter, assuming that air flows through the intake passage by the current intake air amount calculated by the calculation means and ignoring the pressure loss of the bypass passage, is estimated, and wherein the amount of air flowing through the bypass passage, assuming that air flows through the intake passage by the current intake air amount calculated by the calculation means and considering the pressure loss of the bypass passage, is estimated based on the estimated amount of air flowing through the bypass passage ignoring the pressure loss of the bypass passage.

6. A control device for an internal combustion engine as described in claim 1, wherein an in-cylinder charged air amount is estimated based on the air flow meter-detecting intake air amount estimated by the estimating means, the in-cylinder charged air amount being an amount of air having been charged into a cylinder when the intake stroke is completed, and wherein the engine is controlled based on the estimated in-cylinder charged air amount.

7. A control device for an internal combustion engine as described in claim 6, wherein the intake air amount at the closing timing of an intake valve of the engine is estimated, and the in-cylinder charged air amount is estimated by correcting the estimated intake air amount at the closing timing of an intake valve of the engine using the air flow meter-detecting intake air amount estimated by the estimating means.

8. A control device for an internal combustion engine as described in claim 7, wherein the in-cylinder charged air amount is estimated by correcting the estimated intake air amount at the closing timing of an intake valve of the engine using the air flow meter-detecting intake air amount estimated by the estimating means and the actual air flow meter-detecting intake air amount.

9. A control device for an internal combustion engine as described in claim 7, wherein the throttle opening at the closing timing of the intake valve is estimated, and the intake air amount at the closing timing of the intake valve is estimated based on the estimated throttle opening at the closing timing of the intake valve.

10. A control device for an internal combustion engine as described in claim 1, wherein an intake pipe pressure at the closing timing of an intake valve of the engine is estimated based on the air flow meter-detecting intake air amount estimated by the estimating means, the intake pipe pressure being a pressure in the intake passage downstream of the throttle valve, and wherein the engine is controlled based on the estimated intake pipe pressure.

11. A control device for an internal combustion engine as described in claim 1, wherein:

the air flow meter detects a flow rate of air flowing through the bypass passage to detect a flow rate of air flowing through the intake passage;

the calculation means calculates a current throttle valve passing-through air flow rate from the current throttle opening based on the current throttle opening obtained by the obtaining means, the throttle valve passing-through air flow rate being a flow rate of air passing through the throttle valve;

the estimating means estimates an air flow meter-detecting air flow rate, assuming that air flows through the intake passage by the current throttle valve passing-through air flow rate calculated by the calculation means, and considering the pressure loss of the bypass passage of the air flow meter, the air flow meter-detecting air flow rate being a flow rate of air to be detected by the air flow meter; and control means controls the engine based on the air flow meter-detecting air flow rate estimated by the estimating means.

12. A control device for an internal combustion engine as described in claim 1, wherein a fuel amount is calculated from the air flow meter-detecting intake air amount estimated by the estimating means, and the fuel is supplied to the engine at the calculated fuel amount.

* * * * *